US009803515B2

(12) United States Patent
Oka

(10) Patent No.: US 9,803,515 B2
(45) Date of Patent: Oct. 31, 2017

(54) ROLLER LIFTER

(71) Applicant: OTICS CORPORATION, Nishio-shi, Aichi (JP)

(72) Inventor: Hideki Oka, Handa (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 77 days.

(21) Appl. No.: 14/978,594

(22) Filed: Dec. 22, 2015

(65) Prior Publication Data

US 2016/0201522 A1 Jul. 14, 2016

(30) Foreign Application Priority Data

Jan. 9, 2015 (JP) ..... 2015-002784

(51) Int. Cl.
*F01L 1/14* (2006.01)

(52) U.S. Cl.
CPC ..... *F01L 1/14* (2013.01); *F01L 2103/00* (2013.01); *F01L 2105/00* (2013.01); *F01L 2105/02* (2013.01)

(58) Field of Classification Search
CPC ..... F01L 1/14; F01L 2105/02; F01L 2105/00; F01L 2103/00
See application file for complete search history.

(56) References Cited

U.S. PATENT DOCUMENTS 5,307,769 A * 5/1994 Meagher ..... F01L 1/14 123/90.5
8,863,615 B2 10/2014 Yabuuchi et al.
2008/0190237 A1 8/2008 Radinger et al.
2011/0116945 A1 5/2011 Shibata
2012/0125277 A1 5/2012 Chambonneau et al.
2013/0340695 A1 12/2013 Fujii et al.
2015/0082938 A1 3/2015 Schick
2015/0152826 A1 6/2015 Dorn et al.

FOREIGN PATENT DOCUMENTS

DE 102012211113 A1 1/2014
JP 2004-324546 A 11/2004
JP 2008-208713 A 9/2008
JP 2010-059892 A 3/2010
JP 2013-217304 A 10/2013
JP 2014-001706 A 1/2014
WO 2010/139663 A1 12/2010
WO 2013/119214 A1 8/2013

OTHER PUBLICATIONS

Japanese Office Action dated Oct. 18, 2016 in Japanese Patent Application No. 2015-002784 (4 pages including machine translation).
European Extended Search Report for 15003369.4 dated Mar. 15, 2016. (6 pages).

* cited by examiner

*Primary Examiner* — Zelalem Eshete
(74) *Attorney, Agent, or Firm* — Smith, Gambrell & Russell, LLP

(57) ABSTRACT

A roller lifter includes a first member having a pair of opposed portions opposed to each other and a connecting part connecting the opposed portions to each other, a shaft mounted between the opposed portions to rotatably support a roller brought into contact with a cam, a second member independent of the first member and having a cylindrical portion and an elastic mount elastically held between the opposed portions and the cylindrical portion to mount the first member to the second member.

8 Claims, 8 Drawing Sheets

ROLLER LIFTER

CROSS-REFERENCE TO RELATED APPLICATIONS

This application is based upon and claims the benefit of priority from the prior Japanese Patent Application No. 2015-2784 filed on Jan. 9, 2015, the entire contents of which are incorporated herein by reference.

BACKGROUND

1. Technical Field

The present invention relates to a roller lifter.

2. Related Art

Japanese Patent Application Publication No. JP-A-2014-1706 discloses a roller lifter adapted to be incorporated in internal combustion engines of automotive vehicles. The roller lifter includes a roller brought into contact with a cam, a support pin rotatably supporting the roller and a pair of supports having holes through which both ends of the support pin extend, respectively. The ends of the support pin are swaged thereby to be fixed in the respective holes of the supports. The supports are provided integrally on a cylindrical lifter body. The cam is in abutment against the roller, so that movement of the cam is transmitted to a lifter body with the result that the lifter body is reciprocable in an up-down direction in a cylinder head. The lifter body has an outer periphery serving as a sliding surface which slides on an inner periphery of the cylinder head. Accordingly, the outer periphery of the lifter body requires a strict dimensional accuracy in order to be slidable without backlash in the cylinder head.

In the above-described conventional roller lifter, when both ends of the support pin are swaged thereby to be fixed to the respective supports, there is a possibility that both supports would fall inward so that the supports come close to each other. If both supports fall inward, there is a possibility that the outer periphery of the lifter body would be deformed and the dimensional accuracy of the lifter body cannot be maintained at a proper value.

On the other hand, for example, when both supports are separated from the lifter body so that the cylindrical portion constituting the outer periphery of the lifter body is independent of the supports, the cylindrical portion can be avoided from being influenced by the swaging of the support pin, so that the outer periphery of the cylindrical portion of the lifter body can be maintained at a proper value of dimensional accuracy.

In the aforementioned case, however, the supports need to be connected to the cylindrical portion after the support pin has been swaged. Accordingly, the outer periphery of the cylindrical portion has a possibility of suffering some deformation under the influence of processing during connection. Furthermore, the productivity is possibly reduced when the connecting requires much time.

SUMMARY

The present invention was made in view of the foregoing circumstances and an object thereof is to provide a roller lifter which can reliably prevent deformation of the outer periphery of the cylindrical portion and improve the productivity.

A roller lifter according to the invention includes a first member having a pair of opposed portions opposed to each other and a connecting part connecting the opposed portions to each other, a shaft mounted between the opposed portions to rotatably support a roller brought into contact with a cam, a second member independent of the first member and having a cylindrical portion and an elastic mount elastically held between the opposed portions and the cylindrical portion to mount the first member to the second member.

The shaft is mounted between the opposed portions. Since the first member is mounted to the second member in this state, an outer periphery of the cylindrical portion of the second member can be prevented from being influenced by the mounting of the shaft. Furthermore, since the first member is elastically mounted to the second member by the elastic mount, no special processing is required when the first member is mounted to the second member. This can eliminate troubles of the processing and reduce the possibility that the outer periphery of the cylindrical portion may suffer the influence of the assembling of the first member to the second member. Accordingly, the outer periphery of the cylindrical portion can reliably be prevented from being deformed and the productivity can be improved.

DETAILED DESCRIPTION

Figure 1:
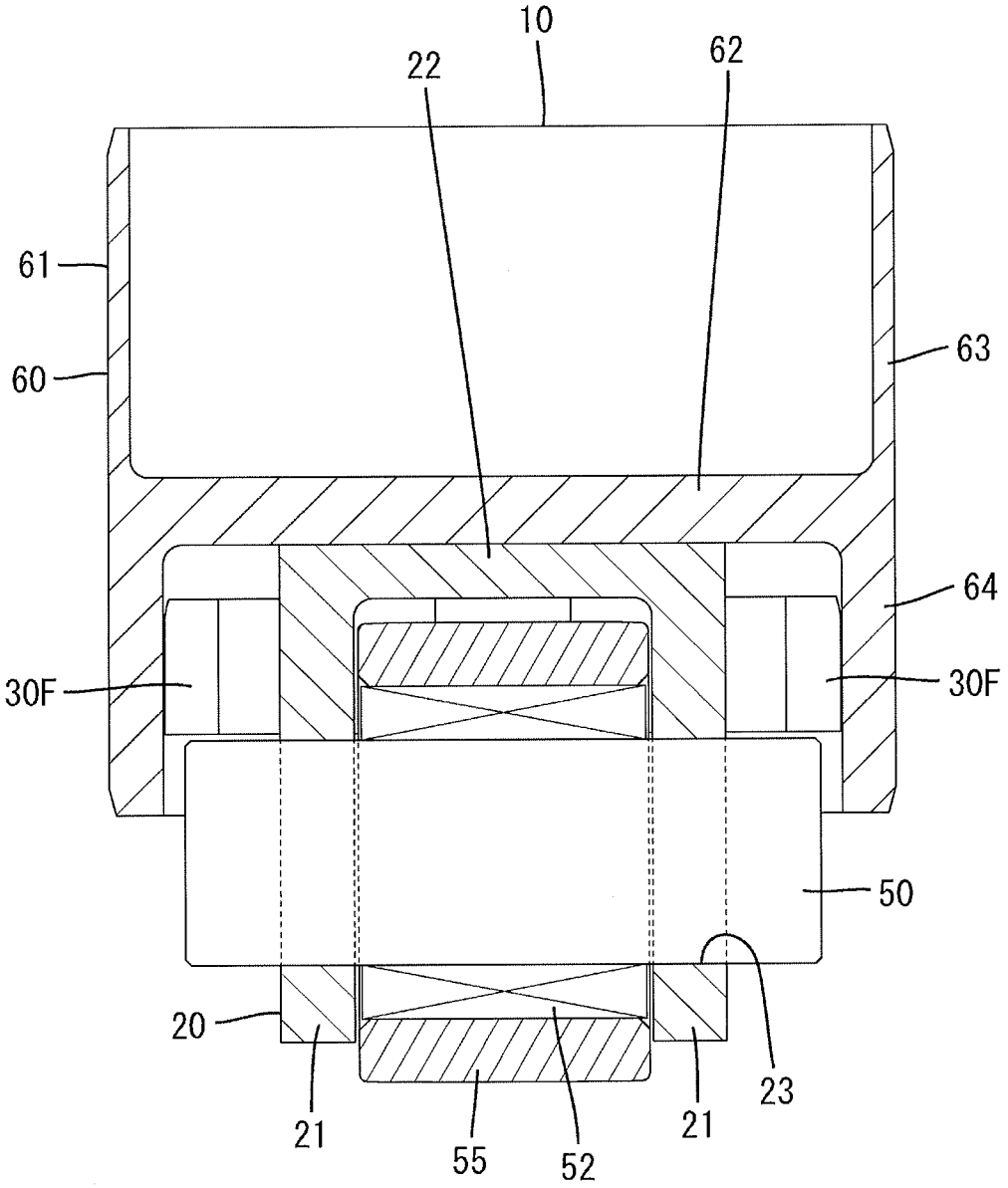
FIG. 1 is a sectional view of a roller lifter according to one embodiment of the invention as viewed from the front thereof.

An embodiment of the invention will be described with reference to FIGS. 1 to 8. In the embodiment, a roller lifter 10 is applied to a pump lifter provided in a fuel supply system 80 of an internal combustion engine. The roller lifter 10 includes a first member 20 and a second member 60, both of which are independent of each other. The first and second members 20 and 60 are mounted to each other with elastic mounts 30F and 30R being interposed therebetween, thereby being prevented from being separated from each other. The elastic mounts 30F and 30R will be described in detail later. In the following description, the left side in FIG. 2 will be referred to as "front" with respect to the front-rear direction.

Figure 5:
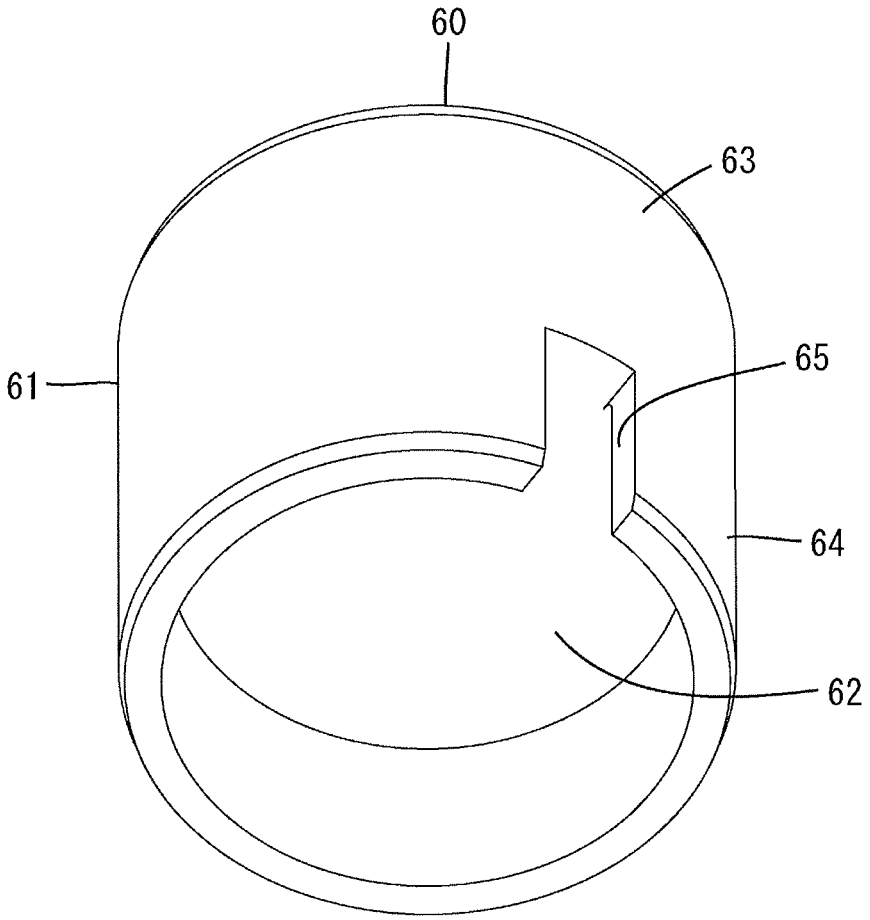
FIG. 5 is a perspective view of a second member as viewed from obliquely downward.
Figure 6:
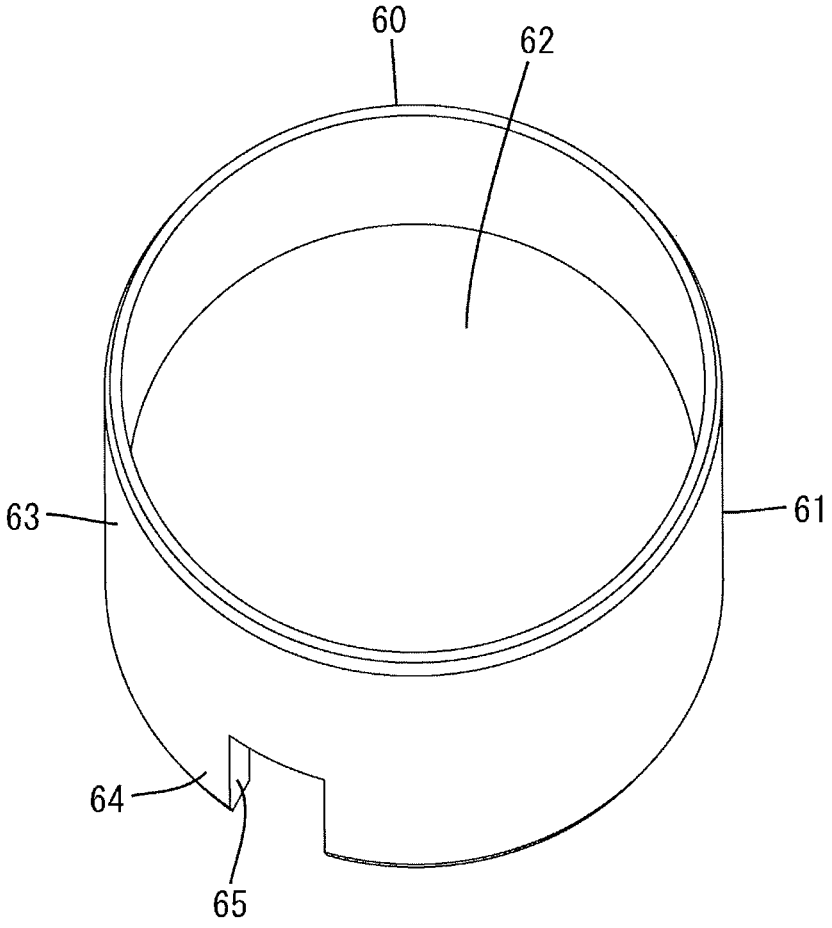
FIG. 6 is a perspective view of the second member as viewed from obliquely upward.

The second member 60 is comprised of a cylindrical portion 61 which is formed integrally therewith as a whole as shown in FIGS. 5 and 6. The cylindrical portion 61 includes a disc-shaped bottom wall 62 extending along a widthwise direction, a cylindrical peripheral wall 63 rising from an outer circumferential edge of the bottom wall 62 and a cylindrical lower peripheral wall 64 falling from the outer circumferential edge of the bottom wall 62. The cylindrical portion 61 has an outer periphery which is continuous from the peripheral wall 63 to the lower peripheral wall 64 over an entire height in a stepless manner, as shown in FIGS. 1 and 2. The peripheral wall 63 has a smaller wall thickness than the bottom wall 62 or the lower peripheral wall 64. The lower peripheral wall 64 includes a front wall part formed with a fitting recess 65 as shown in FIG. 5. The fitting recess 65 has an opening which is rectangular in a front view and extends from the same height position as an underside of the bottom wall 62 to a lower end of the lower peripheral wall 64.

Figure 2:
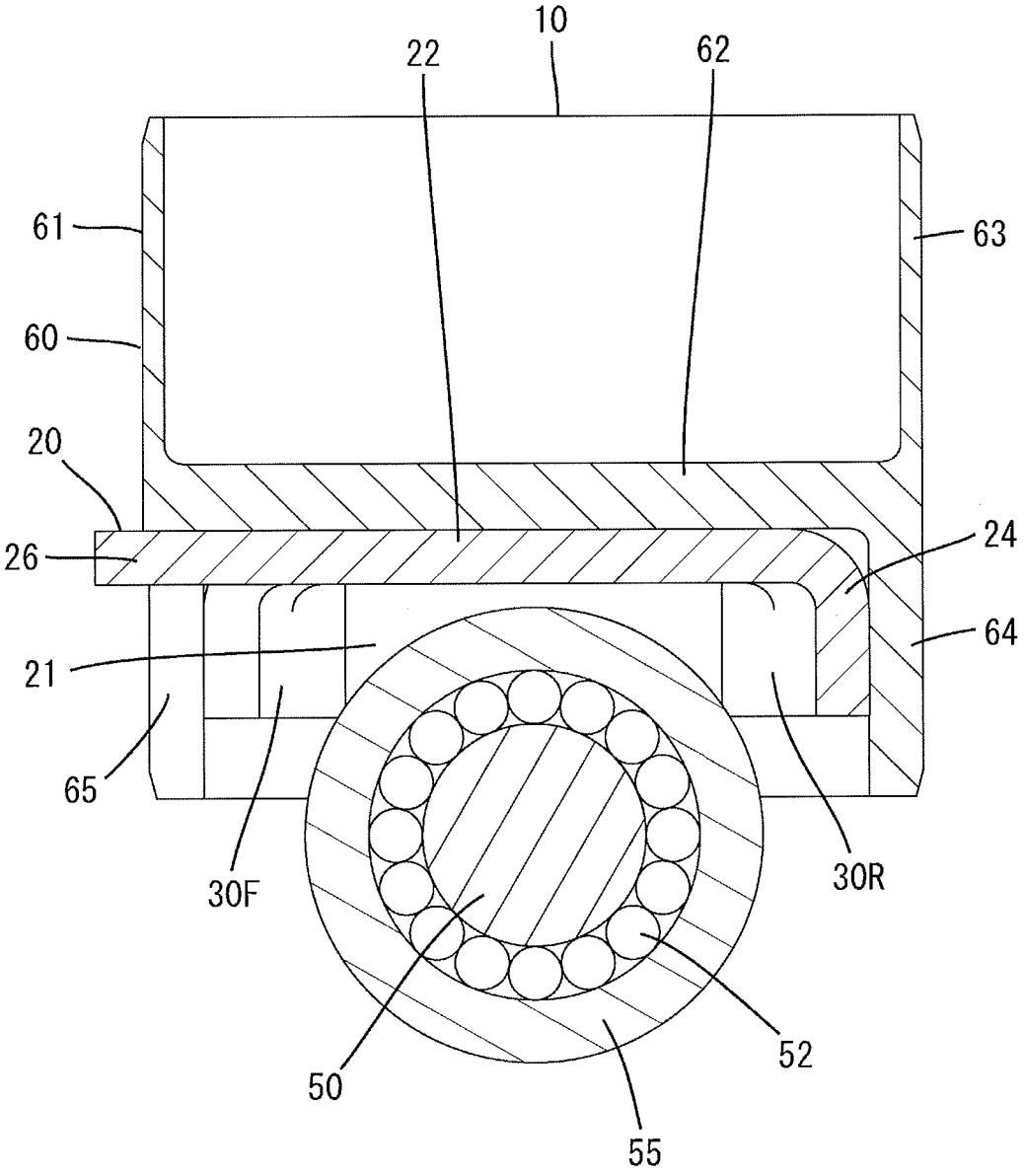
FIG. 2 is a sectional view of the roller lifter as viewed from one side thereof.
Figure 3:
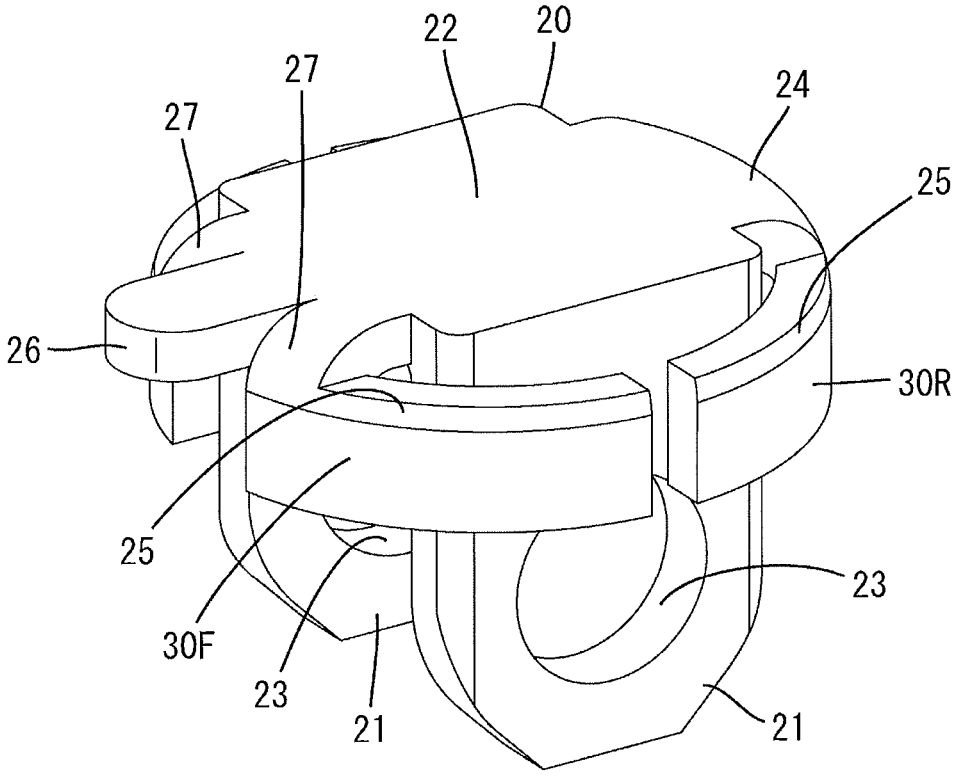
FIG. 3 is a perspective view of a first member as viewed from obliquely upward.
Figure 4:
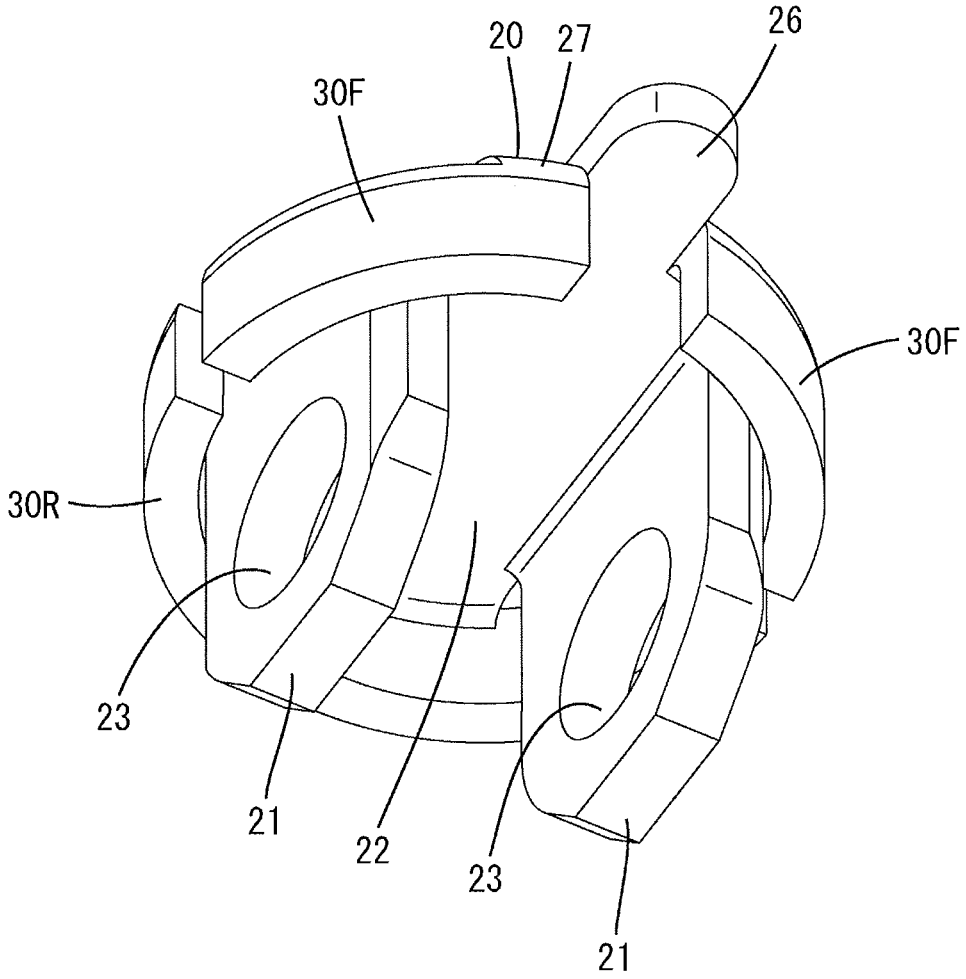
FIG. 4 is a perspective view of the first member as viewed from obliquely downward.

The first member 20 is formed into the shape of an integrally continuous plate as a whole and includes a pair of vertical plate-shaped opposed portions 21 opposed substantially in parallel to each other, a horizontal plate-shaped connecting part 22 which spans upper ends of the opposed portions 21 to connect the opposed portions 21 to each other, and a pair of protrusion-like elastic mounts 30F and a pair of protrusion-like elastic mounts 30R, as shown in FIGS. 3 and 4. The elastic mounts 30F and 30R are located at right and left sides of the connecting part 22, more specifically, at right and left sides of front curves 27 and a rear curve 24 both of which will be described later, respectively. The elastic mounts 30F and 30R further continue into front and rear parts sandwiching the opposed portions 21 respectively. The first member 20 is inserted inside the lower peripheral wall 64 from below and is assembled to the second member 60 with the connecting part 22 in abutment against the underside of the bottom wall 62, as shown in FIGS. 1 and 2.

Figure 8:
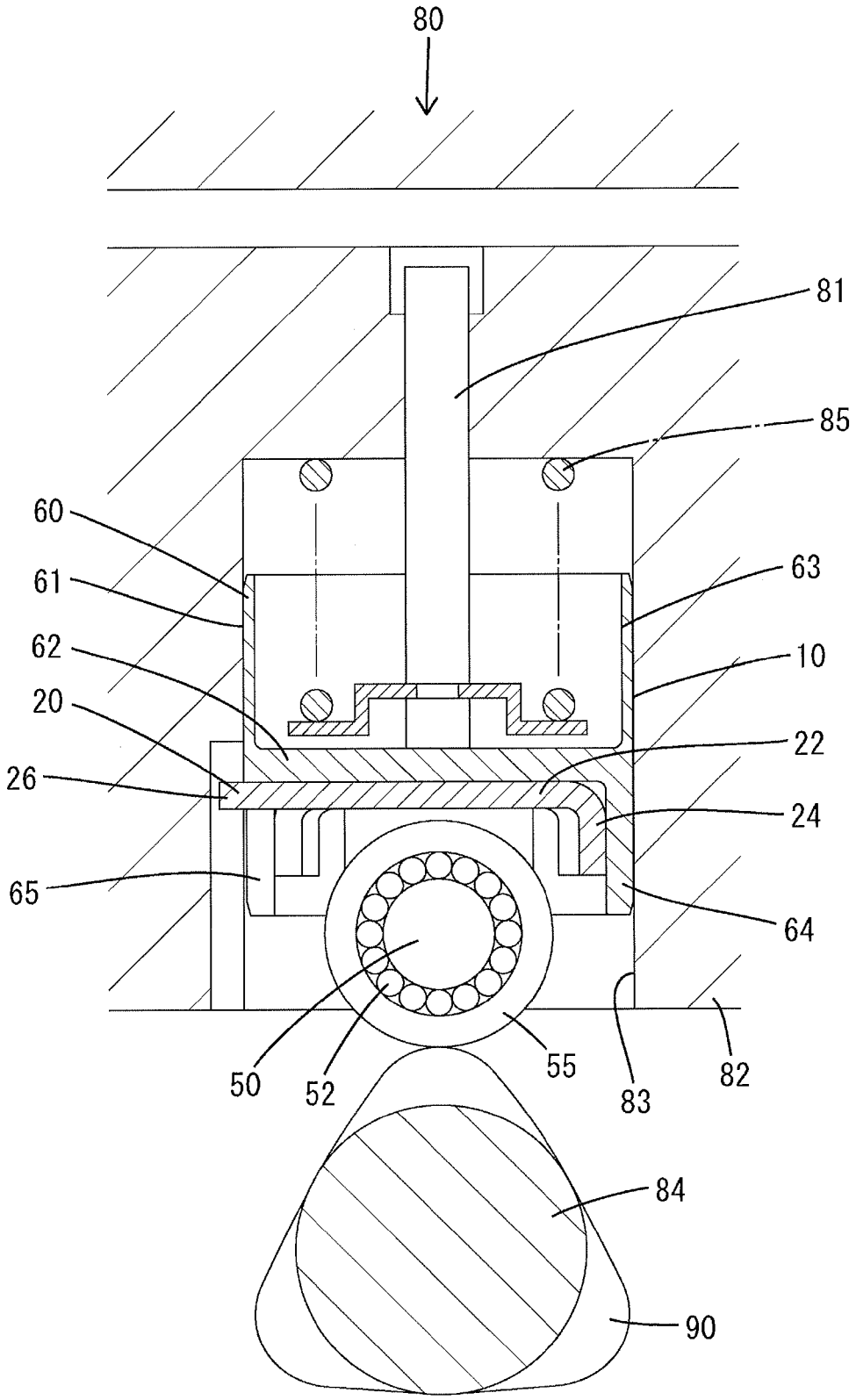
FIG. 8 is a schematic view of a fuel supply system in which the roller lifter is incorporated.

Both opposed portions 21 are formed with bearing holes 23 having circular sections and coaxially extending through them, respectively. A shaft 50 has two ends slidably inserted through the bearing holes 23 respectively, as shown in FIG. 1. The shaft 50 is formed into an elongated cylindrical shape extending straight in a right-left direction. The shaft 50 has an overall length that is longer than a distance between outer sides of the opposed portions 21 and slightly shorter than an inner diameter of the lower peripheral wall 64. Accordingly, both ends of the shaft 50 protrude out of the outer surfaces of the opposed portions 21 respectively. When the first member 20 has been assembled to the second member 60, the ends of the shaft 50 are located in proximity to the inner circumferential surface of the lower peripheral wall 64 so as to be abuttable thereagainst. No processing causing a large deformation, such as swaging, is applied to the end surfaces of the shaft 50. The shaft 50 has an outer periphery on which a cylindrical roller 55 is rotatably mounted via rolling elements 52, as shown in FIG. 2. The roller 55 has an outer periphery in contact with a cam 90 as shown in FIG. 8.

Figure 7:
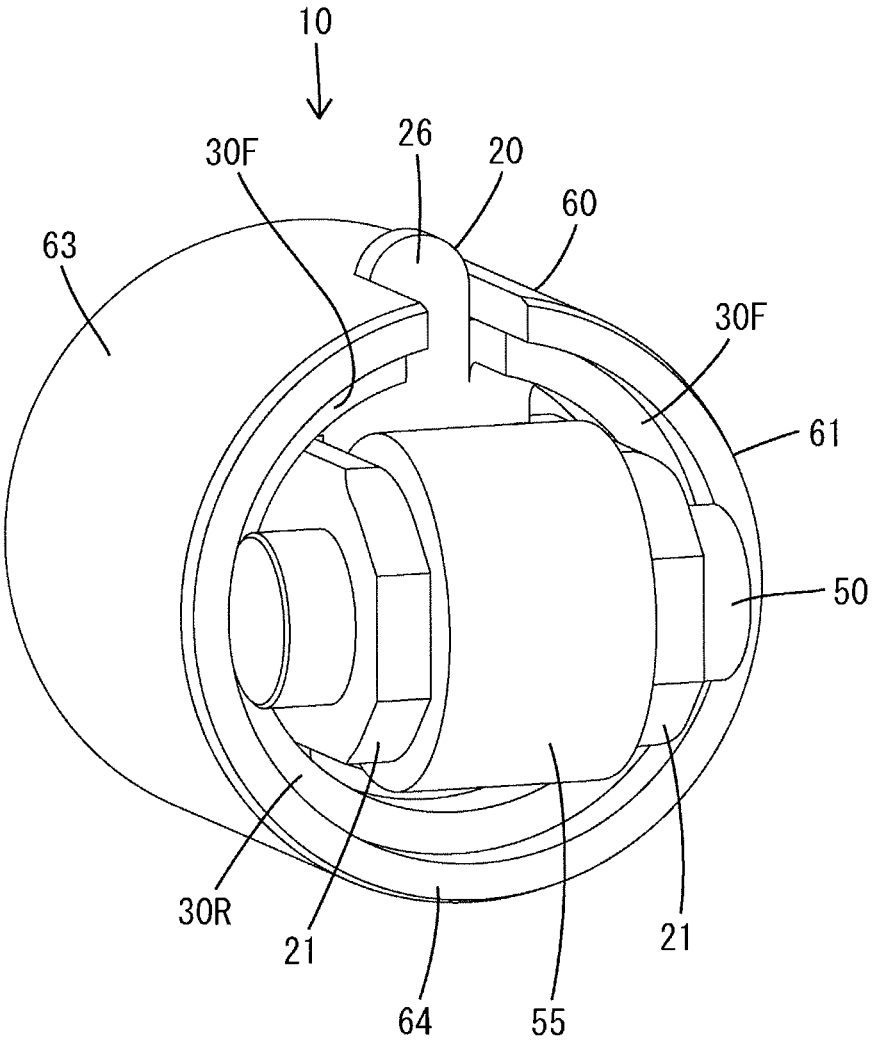
FIG. 7 is a perspective view of the roller lifter as viewed from obliquely downward.

The connecting part 22 has a rear end formed with a rear curve 24 bent downward substantially into an arc shape, as shown in FIG. 3. The rear curve 24 is formed into a wide band shape and has a width corresponding to a distance between upper ends of the opposed portions 21. The rear curve 24 has a distal end (a curved end) provided with a pair of the arc-shaped elastic mounts 30R continuously extending forward from right and left sides of the distal end respectively. Each elastic mount 30R is formed to be curved into a narrow band shape while arc-shaped plate surfaces thereof are directed inward and outward respectively. Each elastic mount 30R is flexurally deformable inward and outward with a connection to the rear curve 24 serving as a fulcrum. Each elastic mount 30R has an upper end outer edge provided with a tapered chamfered part 25. In the process of inserting the first member 20 into the lower peripheral wall 64 from below, the chamfered parts 25 are slid on a lower end inner edge of the lower peripheral wall 64, so that flexural movement of the elastic mounts 30R is induced. The distal end of the rear curve 24 and the elastic mounts 30R are formed into a substantially semi-circular arc shape as a whole in a planar view. When the first member 20 has been inserted inside the lower peripheral wall 64, the distal end of the rear curve 24 and the elastic mounts 30R are located substantially in a face-to-face contact along an inner periphery of the lower peripheral wall 64, as shown in FIG. 7.

The connecting part 22 has a front end formed with a protrusion 26 protruding continuously forward. As shown in FIG. 7, when the first member 20 has been inserted inside the lower peripheral wall 64, the protrusion 26 is fitted into the fitting recess 65, with the result that the first member 20 is prevented from rotation relative to the second member 60 and circumferentially positioned.

The front end of the connecting part 22 is also provided with a pair of front curves 27 formed at both opposite sides of the protrusion 26 so that the protrusion 26 is interposed between the front curves 27, as shown in FIG. 3. The front curves 27 are curved downward into a substantially arc shape. A total width of the front curves 27 and the protrusion 26 corresponds to a distance between upper ends of the opposed portions 21, though each front curve 27 is narrow. The front curves 27 have distal ends (curved ends) provided with a pair of arc-shaped elastic mounts 30F continuously extending rearward from right and left sides of the distal ends respectively. Each elastic mount 30F is formed to be curved into a narrow band shape while arc-shaped plate surfaces thereof are directed inward and outward respectively, in the same manner as each elastic mount 30R. Each elastic mount 30F is flexurally deformable inward and outward with a connection to each front curve 27 serving as a fulcrum. Each elastic mount 30F also has an upper end outer edge provided with a tapered chamfered part 25. The distal ends of the front curves 27 and the elastic mounts 30F are formed into a substantially semi-circular arc shape as a whole in a planar view, except for the protrusion 26. When the first member 20 has been inserted inside the lower peripheral wall 64, the distal ends of the front curves 27 and the elastic mounts 30F are disposed substantially in a face-to-face contact along an inner periphery of the lower peripheral wall 64, as shown in FIG. 7. The front elastic mounts 30F and the rear elastic mounts 30R are disposed substantially symmetrically about the centers of the bearing holes 23 with small gaps between the elastic mounts 30F and 30R. The front elastic mounts 30F and the rear elastic mounts 30R are further disposed on an imaginary circle along the inner circumference of the lower peripheral wall 64.

The roller lifter 10 whose construction has been described above will be assembled as follows. Prior to the assembling of the first member 20 to the second member 60, the shaft 50 is inserted through the bearing holes 23 of the opposed portions 21 of the first member 20. In this case, the shaft 50 is inserted through the bearing holes 23 so as to extend from one of the bearing holes 23 to the other, so that both ends of the shaft 50 protrude outward from outside surfaces of the opposed portions 21 respectively. At this stage, the shaft 50 can be pulled out of the bearing holes 23 of the opposed portions 21.

Subsequently, the first member 20 is inserted inside the lower peripheral wall 64. During insertion of the first member 20, the protrusion 26 is moved into the fitting recess 65 thereby to be positioned, and the elastic mounts 30F and 30R are flexurally deformed gradually along the chamfered parts 25. When having normally been inserted inside the lower peripheral wall 64, the first member 20 is disposed so that an upper surface of the connecting part 22 is in abutment against an underside of the bottom wall 62 substantially in a face-to-face contact, and the elastic mounts 30F and 30R elastically abut against the inner periphery of the lower peripheral wall 64 along the inner periphery from an inner side (see FIGS. 1, 2 and 7). The first member 20 is mounted so as to be prevented from separation from the second member 60 when the elastic mounts 30F and 30R have elastically abutted against the inner periphery of the lower peripheral wall 64.

Furthermore, when having normally been inserted inside the lower peripheral wall 64, the first member 20 is disposed so that both end surfaces of the shaft 50 come close to the inner periphery of the lower peripheral wall 64 so as to be abuttable against the inner periphery, as shown in FIG. 1. Accordingly, even if the shaft 50 is about to be displaced in the widthwise direction with respect to the opposed portions 21, the end surfaces of the shaft 50 abut against the inner periphery of the lower peripheral wall 64, so that the shaft 50 is prevented from further displacement and from pull-out from the bearing holes 23. When having been mounted to the second member 60, the first member 20 is disposed so that a substantially lower half of the roller 55 is exposed below the lower end of the lower peripheral wall 64.

Next, the roller lifter 10 is incorporated into a fuel supply system 80 as shown in FIG. 8. In this case, an engaging member 81 such as a plunger is inserted inside the peripheral wall 63 of the cylindrical portion 61 from above, and the cylindrical portion 61 is then fitted into a sliding hole 83 of a cylinder head 82, so that the cam 90 provided on a cam shaft 84 abuts against the roller 55 from below. The engaging member 81 has a lower end which is in abutment against an upper surface of the bottom wall 62 in a butted state and is biased downward (to the side where the cam 90 is located) by an elastic member 85 such as a coil spring. As a result, the lower end of the engaging member 81 is maintained in abutment against the upper surface of the bottom wall 62. Furthermore, the first and second members 20 and 60 are held between the cam 90 and the engaging member 81 in the up-down direction, whereby the connecting part 22 of the first member 20 and the bottom wall 62 of the second member 60 are maintained in abutment against each other. In particular, since the connecting part 22 is in abutment against an underside of the bottom wall 62 of the cylindrical portion 61 in a face-to-face contact while being pressed by the cam 90, the connecting part 22 and the bottom wall 62 are successfully maintained in an abutting state. This can reliably prevent separation of the first member 20 from the second member 60.

Upon rotation of the cam 90 with drive of the internal combustion engine, the cylindrical portion 61 is reciprocated in the up-down direction with stroke according to a valve lift of the cam 90. Furthermore, the engaging member 81 is reciprocated in the up-down direction so that operating oil is pressure-fed. In this case, the outer periphery of the cylindrical portion 61 requires a high dimensional accuracy since the outer periphery of the cylindrical portion 61 slides on the inner periphery of the sliding hole 83. In this regard, the roller lifter 10 is dividable into the first member 20 having the opposed portions 21 and the second member 60 having the cylindrical portion 61 in the embodiment. Furthermore, the first member 20 is assembled to the second member 60 after the shaft 50 has been inserted through the opposed portions 21. Accordingly, even if the opposed portions 21 may be deformed when the shaft 50 is inserted through the opposed portions 21, the influences of the deformation are not transmitted to the cylindrical portion 61 with the result that the dimensional accuracy of the outer periphery of the cylindrical portion 61 can successfully be maintained.

Particularly in the embodiment, the shaft 50 is merely inserted into the bearing holes 23 of the respective opposed portions 21 but is not swaged and fixed to the opposed portions 21. As a result, the opposed portions 21 can be prevented from deformation with the assembling of the shaft 50 to the opposed portions 21.

According to the foregoing embodiment, the shaft 50 spans the opposed portions 21 and in this state, the first member 20 is mounted to the second member 60, as described above. As a result, the influences of the assembling of the shaft 50 cannot be transmitted to the outer periphery of the cylindrical portion 61 in the second member 60.

Furthermore, since the first member 20 is elastically mounted to the second member 60 by the elastic mounts 30F and 30R, no special processing such as swaging is required in the mounting of the first member 20 to the second member 60. This can eliminate troubles of the processing and reduce the possibility that the outer periphery of the cylindrical portion 61 may suffer the influence of the assembling of the first member 20 to the second member 60. Accordingly, the outer periphery of the cylindrical portion 61 can reliably be prevented from being deformed and productivity can be improved.

Furthermore, when the first member 20 is inserted inside the lower peripheral wall 64 of the cylindrical portion 61, the elastic mounts 30F and 30R elastically abut against the inner periphery of the cylindrical portion 61 from the inner side. Accordingly, the elastic mounts 30F and 30R are protected in the cylindrical portion 61 against external foreign matter. As a result, the elastic mounts 30F and 30R can be prevented from inadvertent elastic deformation, and the first member 20 can accordingly be avoided from dropout from the second member 60. In particular, a plurality of the elastic mounts 30F and a plurality of the elastic mounts 30R are provided on the first member 20 and are curved along the inner periphery of the cylindrical portion 61 into arc shapes. As a result, the elastic mounts 30F and 30R can stably be held on the inner periphery of the cylindrical portion 61.

Furthermore, when the first member 20 has been assembled to the second member 60, the shaft 50 is disposed so that both end surfaces thereof are abuttable against the inner periphery of the cylindrical portion 61. As a result, the shaft 50 can be prevented from pull-out from the bearing holes 23, so that the shaft 50 is held on the opposed portions 21 in a come-off prevented state. In particular, since the shaft 50 is not swaged to be fixed to the opposed portions 21, the opposed portions 21 can be prevented from being deformed so as to fall inward.

Still furthermore, the shaft 50 is slidable in the bearing holes 23 of the respective opposed portions 21 and is rotatably supported on the opposed portions 21. Accordingly, an area of load acting on the shaft 50 changes around an axis of the shaft 50 and is not limited to a certain area. As a result, the service lives of the shaft 50 and the opposed portions 21 can be improved.

Other embodiments will briefly be described.

(1) For example, protrusions may be provided on one of the outer surfaces of the elastic mounts and the inner periphery of the cylindrical portion and recesses may be provided in the other, whereby the elastic mounts can be maintained in abutment against the cylindrical portion by fitting the protrusions into the respective recesses after flexure of the elastic mounts.

(2) The elastic mounts may be provided on the second member.

(3) The elastic mounts may be independent of the first and second members and may elastically be held between the first and second members when the first and second members are mounted.

(4) Both ends of the shaft may be inserted through the opposed portions and swaged to be fixed.

(5) Both ends of the shaft may be supported on the opposed portions so as to be substantially non-rotatable.

(6) The invention may be applied to a valve lifter provided in a valve gear.

What is claimed is:

1. A roller lifter comprising:

a first member having a pair of opposed portions opposed to each other and a connecting part connecting the opposed portions to each other;

a shaft mounted between the opposed portions to rotatably support a roller brought into contact with a cam;

a second member independent of the first member and having a cylindrical portion; and an elastic mount elastically held between the opposed portions and the cylindrical portion to mount the first member to the second member, wherein the shaft has two ends which are disposed so as to extend through bearing holes of the opposed portions and so as to protrude outward from outer surfaces of the opposed portions respectively, and the shaft is rotatable in the bearing holes of the opposed portions;

wherein the shaft is configured such that the shaft can be pulled out of the bearing holes of the opposed portions prior to assemblage of the first member to the second member; and wherein when the first member has been assembled to the second member, the shaft is disposed so that both end surfaces thereof are abuttable against an inner periphery of the cylindrical portion, with a result that the shaft is prevented from pull-out from the bearing holes.

2. The roller lifter according to claim 1, wherein the first member is received within the cylindrical portion and the elastic mount is provided on the first member to elastically abut against an inner periphery of the cylindrical portion from an inner side.

3. The roller lifter according to claim 2, wherein the elastic mount is curved along the inner periphery of the cylindrical portion into an arc shape.

4. The roller lifter according to claim 1, wherein the connecting part abuts against a bottom wall of the cylindrical portion while being pressed by the cam.

5. The roller lifter according to claim 3 wherein there is a plurality of elastic mounts on the first member.

6. The roller lifter according to claim 5 wherein each of the plurality of elastic mounts on the first member is curved along the inner periphery of the cylindrical portion into an arc shape.

7. The roller lifter according to claim 1 wherein there is a plurality of elastic mounts on the first member.

8. The roller lifter according to claim 7 wherein each of the plurality of elastic mounts on the first member is curved along the inner periphery of the cylindrical portion into an arc shape.

* * * * *